US006457808B1

(12) United States Patent
Chang et al.

(10) Patent No.: US 6,457,808 B1
(45) Date of Patent: Oct. 1, 2002

(54) MULTI-COLOR LEVEL INKJET HEAD CHIP STRUCTURE

(75) Inventors: Charles C. Chang, Hsinchu; Ching-Long Chiu, Tainan Hsien; Shyh-Haur Su, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/934,669

(22) Filed: Aug. 23, 2001

(30) Foreign Application Priority Data

Feb. 23, 2001 (TW) ..... 90104126 A

(51) Int. Cl.[7] ..... B41J 2/25

(52) U.S. Cl. ..... 347/43; 347/15

(58) Field of Search ..... 347/43, 15, 12, 347/40, 62, 47, 65

(56) References Cited

U.S. PATENT DOCUMENTS 4,614,953 A * 9/1986 Lapeyre ..... 347/43
6,062,678 A * 5/2000 Ishinaga et al. ..... 347/62

* cited by examiner

*Primary Examiner*—Lamson D. Nguyen
(74) *Attorney, Agent, or Firm*—Birch, Stewart, Kolasch & Birch, LLP

(57) ABSTRACT

A multi-color level inkjet head chip structure includes a pre-mixing space. The pre-mixing space communicates with different ink storage spaces through a plurality of providing elements, then the volume of different colored inks is controlled by the ink providing elements to be injected into the pre-mixing space. The desired color level ink is created in the pre-mixing space in advance. Finally, the desired color level pre-mixed ink is ejected onto the recording media (such as paper or other similar material) through an inkjet printing driver at the pre-mixing space. Therefore, the desired color level can be produced by only one inkjet printing at any printing area, which will be extremely beneficial for increasing the speed of inkjet printing.

18 Claims, 5 Drawing Sheets

MULTI-COLOR LEVEL INKJET HEAD CHIP STRUCTURE

TECHNICAL FIELD

The present invention relates to an inkjet head chip structure, and more particularly to a multi-color level inkjet head chip structure, which is utilized in multi-color level inkjet printing technology, to provide a higher inkjet printing speed.

BACKGROUND OF THE INVENTION

After multi-color level inkjet-printing technology was successfully developed, it provided abundant colors for printing, enabling the printing quality of an image to be significantly improved. However, the developmental direction of the present technology necessitates not only more abundant colors and higher printing resolution, but also higher printing speed.

The conventional inkjet printer normally uses methods such as decreasing the dimensions of ink drops to increase printing resolution, and then providing abundant color levels through controlling the numbers of each color ink drop in accordance with halftone control technology, so as to provide improved printing quality when printing in color (especially when printing color images). Therefore, at present, inkjet printers that claim to produce ink drops smaller than 1 pl with a resolution greater than 2400 dpi (dot per inch) are available on the market. However, for normal high quality printing matter, a resolution of 600 dpi is enough, and although the ink drop is larger than 10 pl, it is difficult to see a difference between this level of resolution and any higher resolution. Moreover, it is preferable to use inkjet nozzles with extremely tiny dimensions in order to produce such tiny ink drops. However, if the inkjet nozzle is minimized as such, it can easily become blocked.

Although presently available inkjet printers already have the ability to minimize the sprayed-out ink drop, the method they use to process multi-color level printing is still to employ many different colored inks to apply different colors onto recording media (such as normal paper, inkjet printing paper for special use or other similar materials), and the mixing of different color inks is done on the-surface of the recording media. Therefore, repeated applications must be done on the same area with different color inks in order to obtain the desired color level, and after the color mixing through the control of the ejected volumes of different color inks. So even if the effect of increasing color level change can be achieved through minimizing the ink drop dimensions, this still cannot solve the problem of insufficient printing speed when processing multi-color level printing with inkjet printers.

SUMMARY OF THE INVENTION

The main object of the invention is to provide an inkjet head chip structure for increasing the speed of multi-color level printing.

The invention mainly discloses a pre-mixing space in an inkjet head chip. Different colored ink is injected into the pre-mixing space by an ink providing element, and the different colors are mixed together. The desired ink volume is expelled into the-pre-mixing space by controlling the energy of each ink providing element according to a desired final printing color level. The ink is then pre-mixed to reach the desired color level and is ejected onto the recording media by means of an inkjet printing driver disposed at the pre-mixing space. Such an inkjet head chip structure only requires pre-mixing at one time, after which the ink is ejected onto the recording media. This achieves the same printing effect as that achieved by ejecting several ink drops of different colors (often requiring 8 drops or even 16 drops in single multi-level color) onto the recording media in the traditional art. By comparison, the present invention will greatly improve the printing speed of the traditional art.

In one preferred embodiment of the invention, we can adopt the manner in which different colored inks are injected into the pre-mixing space and mixed so as to obtain the desired color level ink. The ink is then ejected out to print by means of the inkjet printing element. In another preferred embodiment of the invention, each pre-mix principal high-density colorant and the matched solvent are put into the pre-mixing space, to dilute ink to the degree necessary. These diluted principal colorants are then ejected onto recording media to achieve the desired color level. Compared with the printing method of the traditional art, in which the volume of different colored ink drops is controlled and ejected onto recording media to achieve the desired color level, the invention controls the volume of ink to achieve the desired color level before ejecting ink onto the recording media. This will reduce the time needed for ejecting ink drops, and attain the effect of increasing printing speed.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENT OF THE INVENTION

Figure 1:
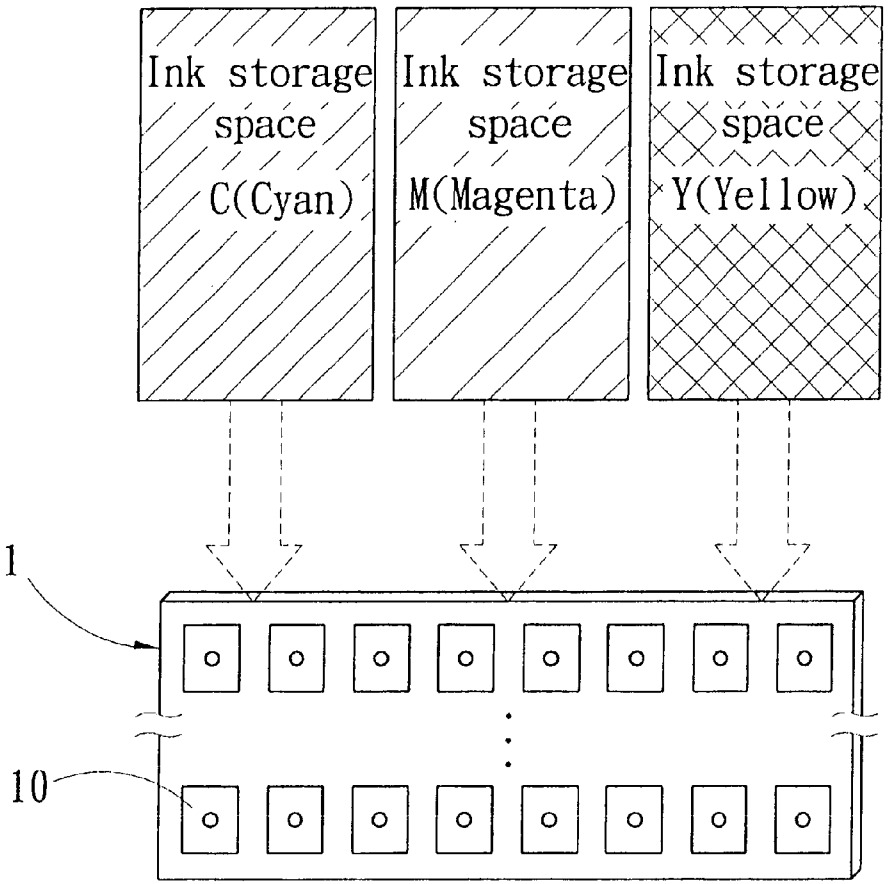
FIG. 1 is a diagram of an inkjet head chip of the invention, showing the function of every part.

First, FIG. 1 shows a function block diagram of an inkjet head chip 1 and related elements. The inkjet head chip 1 communicates with several ink storage spaces in which different colored inks are stored. Ink colors needed for printing are supplied by each ink storage space, and the ink is ejected onto the recording media through the energy provided by the inkjet head chip 1. Because most color inkjet printers use three different colored inks, i.e. C (cyan), M (Magenta) and Y (yellow), the preferred embodiments described below will take a first ink storage space 20*a*. second ink storage space 20*b* and third ink storage space 20*c* that respectively store the C, M and Y colored inks as an example.

The inkjet head chip 1 comprises a plurality of inkjet printing units 10 arranged in a particular manner (normally arranged in a matrix style). Each inkjet printing unit 10 has an ink nozzle (not shown in the drawing). The nozzles are like a plurality of tiny needle holes arranged on the outside surface of the inkjet head chip, when seen from the outside, and ink provided by the ink storage spaces 20*a,* 20*b* and 20*c* is mixed in the inkjet printing units 10 first then passed through the ink nozzles to be ejected onto the surface of the recording media. The effect of multi-color level printing is thus attained.

Figure 2:
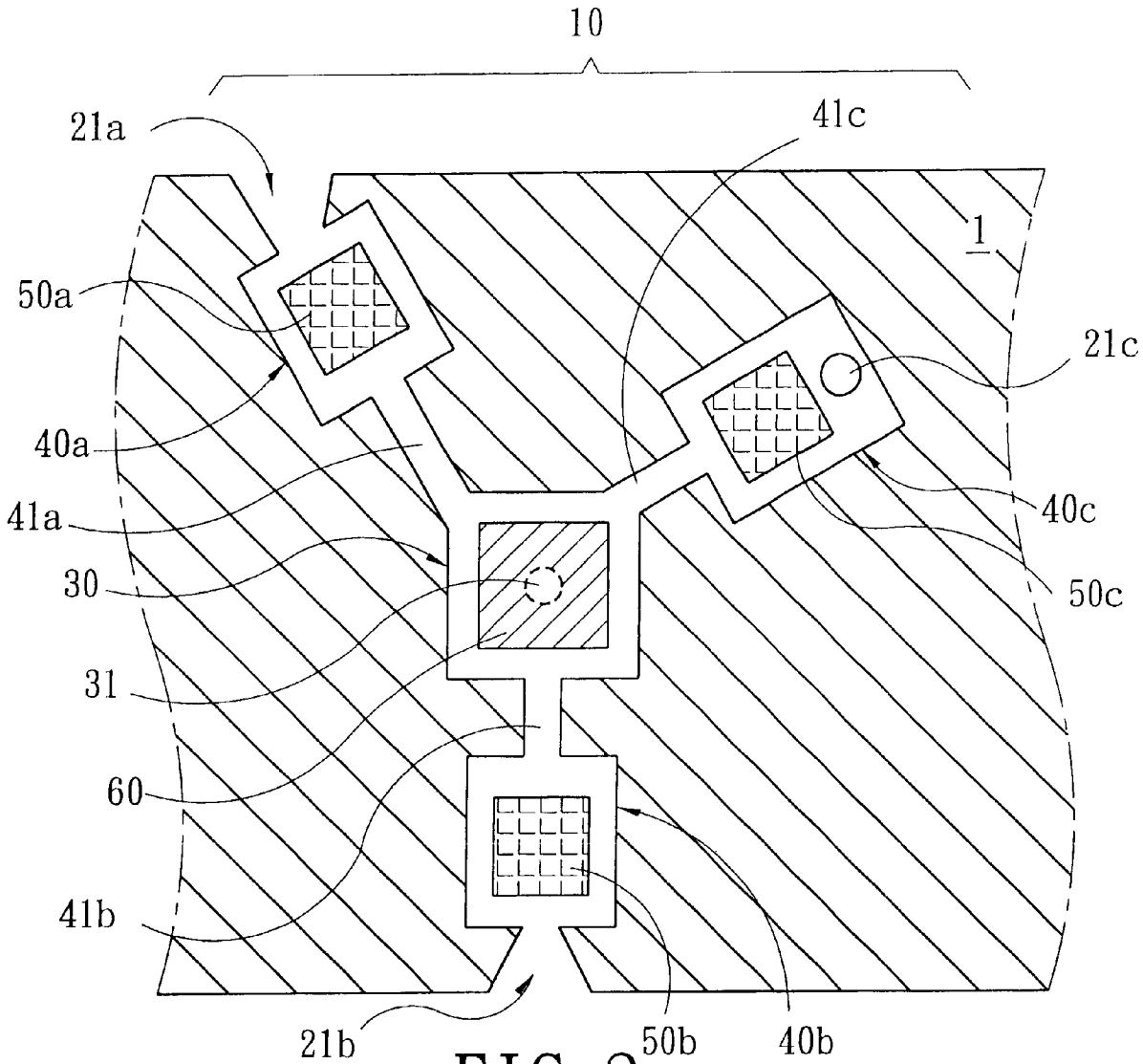
FIG. 2 is a diagram of one preferred embodiment of the invention, showing the disposition of inkjet printing elements.

One embodiment of the invention discloses that the structure of each inkjet printing unit 10 is the same, as shown in FIG. 2. It comprises:

A pre-mixing space 30, including an ink nozzle 31, allows the mixed ink to pass through it and be ejected onto the surface of the recording media.

A plurality of ink providing elements, which are respectively: a first color-combined-ink providing element 40a that allows for communication between the pre-mixing space 30 and the first ink storage space 20*a,* a second color-combined-ink providing element 40*b* that allows for communication between the pre-mixing space 30 and the second ink storage space 20*b,* and a third color-combined-ink providing element 40*c* that allows for communication between the pre-mixing space 30 and the third ink storage space 20*c*.

A plurality of ink providing drivers, which are respectively: a first ink providing driver 50*a* disposed in the first ink providing element 40*a,* a second ink providing driver 50*b* disposed in the second ink providing element 40*b,* and a third ink providing driver 50*c* disposed in the third ink providing element 40*c*. The different color-combined-ink providing elements 40*a,* 40*b* and 40*c* inject different colored inks, according to preset ink quantities for the desired color level, into the pre-mixing space 30, to be mixed together through the energy control on the ink providing drivers 50*a,* 50*b* and 50*c* respectively so as to obtain the desired color level ink.

An inkjet printing driver 60, disposed in the mixing space 30, is utilized to eject the mixed ink onto the surface of the recording media via an ink nozzle 31.

The three above-mentioned ink providing drivers 50*a,* 50*b* and 50*c,* as well as the printing inkjet deriver 60, may utilize the heat resistant thin film method to eject ink. As with the operation principle of the traditional thermal bubble type ink jet head chip, we can get thermal bubbles by heating the heat resistant thin film to cause the bubbles to be expanded instantly, and then expel out the ink with the necessary quantity. So the ink, which comes from the three different colored ink storage spaces 20*a,* 20*b* and 20*c,* will be mixed in the pre-mixing space 30 to first create the desired color level. The mixed ink is then ejected onto the recording media (such as normal paper, inkjet printing paper for special use or other similar material), and the desired printing effect with the desired color level on the surface of the recording media can more quickly be obtained. The method utilized here is different from the traditional technology in which ink drops with different volumes and colors are repeatedly ejected onto the recording media. So, the design of the invention can expedite printing while maintaining equal or better printing quality.

The three above-mentioned ink providing elements 40*a,* 40*b* and 40*c* are disposed around the pre-mixing space 30. They are connected to the premixing space 30 by means of a first tunnel 41*a,* second tunnel 41*b* and third tunnel 41*c* respectively. The three tunnels lead the ink into locations of the pre-mixing space 30, which are disposed symmetrically to the center of the pre-mixing space 30. If they are disposed at equally divided parts of the circumference of a circle that takes the center of the pre-mixing space 30 as its center, the mixing effect will be better. With such an arrangement the different colored inks are injected respectively into the pre-mixing space 30 by means of the three ink providing elements 40*a,* 40*b* and 40*c* to mix together uniformly. Moreover, if a whirlpool-like mixing effect can be generated after the three different colored inks are injected into the pre-mixing space 30, more uniform mixing can be achieved.

Figure 3:
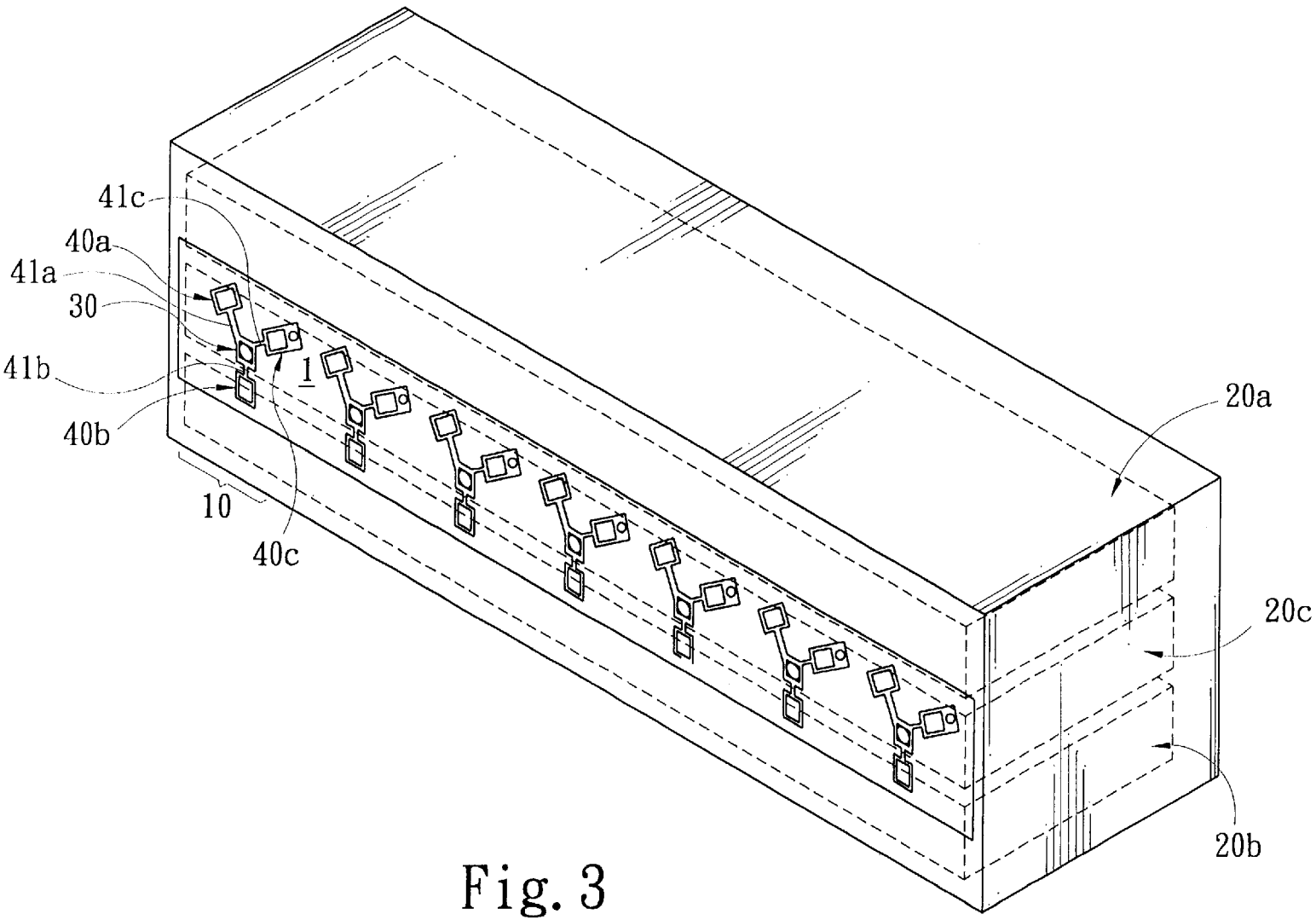
FIG. 3 is a perspective view of one preferred embodiment of the invention, the connection between each inkjet-printing element in an ink storage space and inkjet head chip.

FIG. 3 shows the connection relationship between the ink storage spaces 20*a,* 20*b* and 20*c* that store the three different colored inks and the inkjet printing units 10 in the inkjet head chip 1. The three ink storage spaces 20*a,* 20*b* and 20*c* are all installed on the same side of the inkjet head chip 1 (and on the back side relative to the ink nozzle 31). They are connected to the ink providing elements 40*a,* 40*b* and 40*c* via ink providing tunnels 21*a,* 21*b* and 21*c,* which are parallel or perpendicular to the surface of the inkjet head chip so that they can provide the necessary ink to the three ink providing elements 40*a,* 40*b* and 40*c*.

Figure 4A:
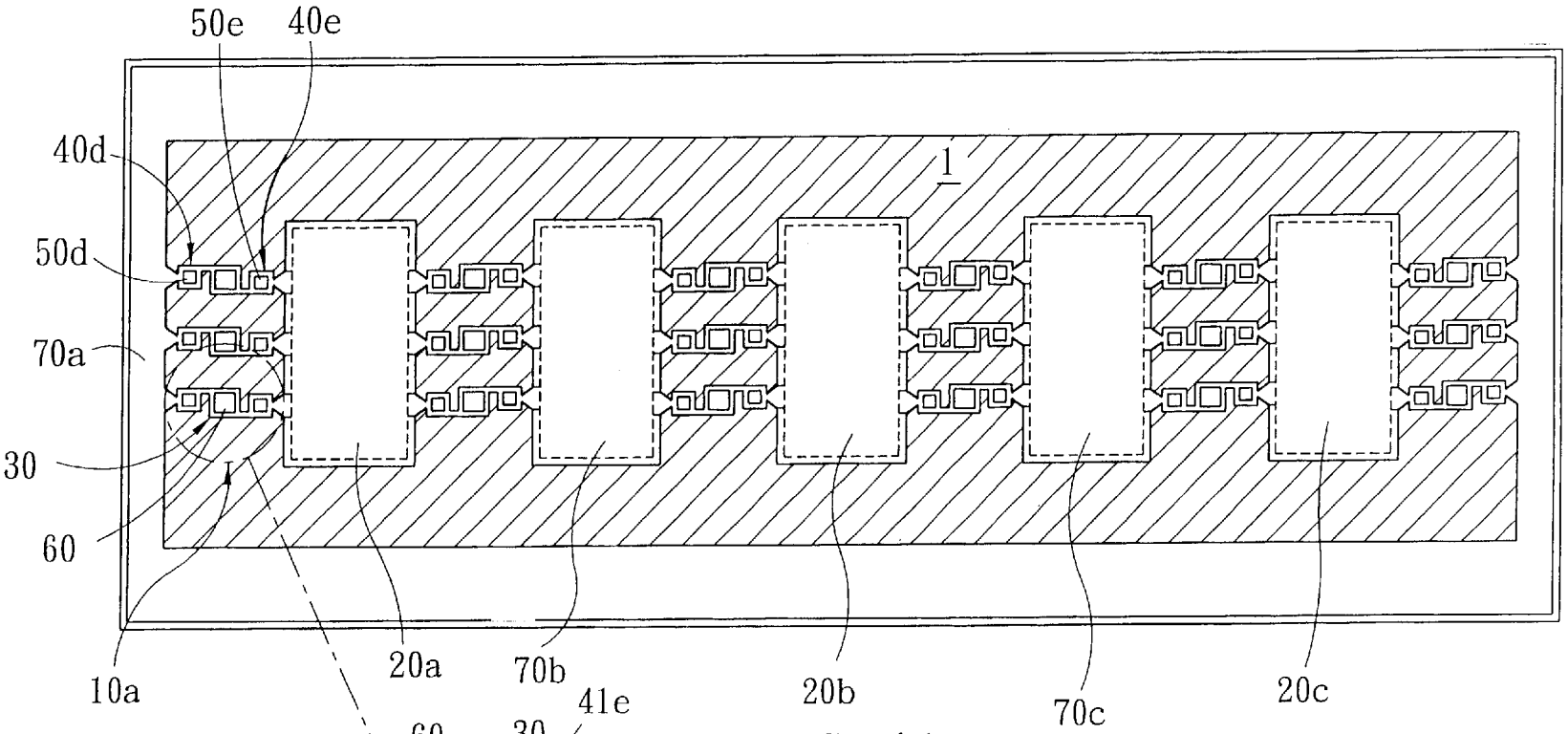
FIG. 4A is a diagram of another preferred embodiment of the invention, showing the disposition of inkjet printing elements and ink storage space.

As shown in FIG. 4A, in another embodiment of the invention, different high-density colorants and matching solvents are stored respectively in different ink storage space. One or more inkjet printing units 10*a* are disposed between the ink storage spaces 20*a,* 20*b* and 20*c,* in which the high-density colorants are stored, and their matching solvent storage spaces 70*a,* 70*b* and 70*c*. Each of these inkjet printing units 10*a* comprises:

a pre-mixing space 30, having an ink nozzle 31 therein, which can allow the mixed ink to pass through it and be ejected onto the recording media surface:

a printing inkjet driver 60, disposed in the pre-mixing space 30, which is utilized to eject the mixed color level ink onto the surface of recording media via the ink nozzle 31;

two ink providing elements 40d and 40e, the former allowing for communication between the pre-mixing space 30 and the adjoining ink storage space (20*a* or 20*b* or 20*c*), and the latter allowing for communication between the pre-mixing space 30 and the adjoining solvent storage space (70*a* or 70*b* or 70*c*); and two ink-providing drivers 50*d* and 50*e* disposed in the ink providing elements 40*d* and 40*e*.

Figure 4B:
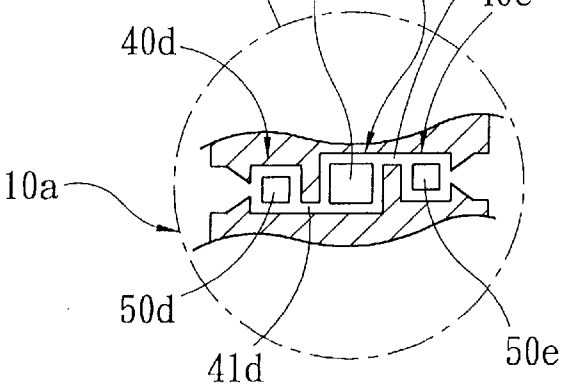
FIG. 4B is an enlarged view of the part structure shown in FIG. 4A, showing the shape and disposition of each element in a inkjet printing element.

In the above-mentioned preferred embodiment of the invention, the position of a fourth tunnel 41*d* and fifth tunnel 41*e,* which are utilized to connect the two ink providing elements 40*d* and 40*e* with the pre-mixing space 30, has been arranged accordingly, as shown in FIG. 4B. The fourth tunnel 41*d* and fifth tunnel 41*e* are utilized to lead the solvents or high-density colorants into the pre-mixing space 30 through the edge of the pre-mixing space. They form a whirlpool-like current in the pre-mixing space 30 through the force generated by the solvent or high-density colorant being injected into the pre-mixing space 30. This allows for improved mixing results with the solvent and high-density colorant.

The two above-mentioned ink providing drivers 50*d* and 50*e,* and the inkjet printing driver 60, can all inject the necessary high-density colorant and solvent into the same pre-mixing space 30 to mix by controlling the energy of the heat resistant thin film. The mixed ink is then diluted to match the desired color level, and is ejected onto the surface of the recording media via the ink nozzle 31 by means of the inkjet printing driver 60. This method is to pre-mix the ink in the pre-mixing space 30 to achieve the desired color level, then eject the mixed ink onto recording media at one time.

Figure 5:
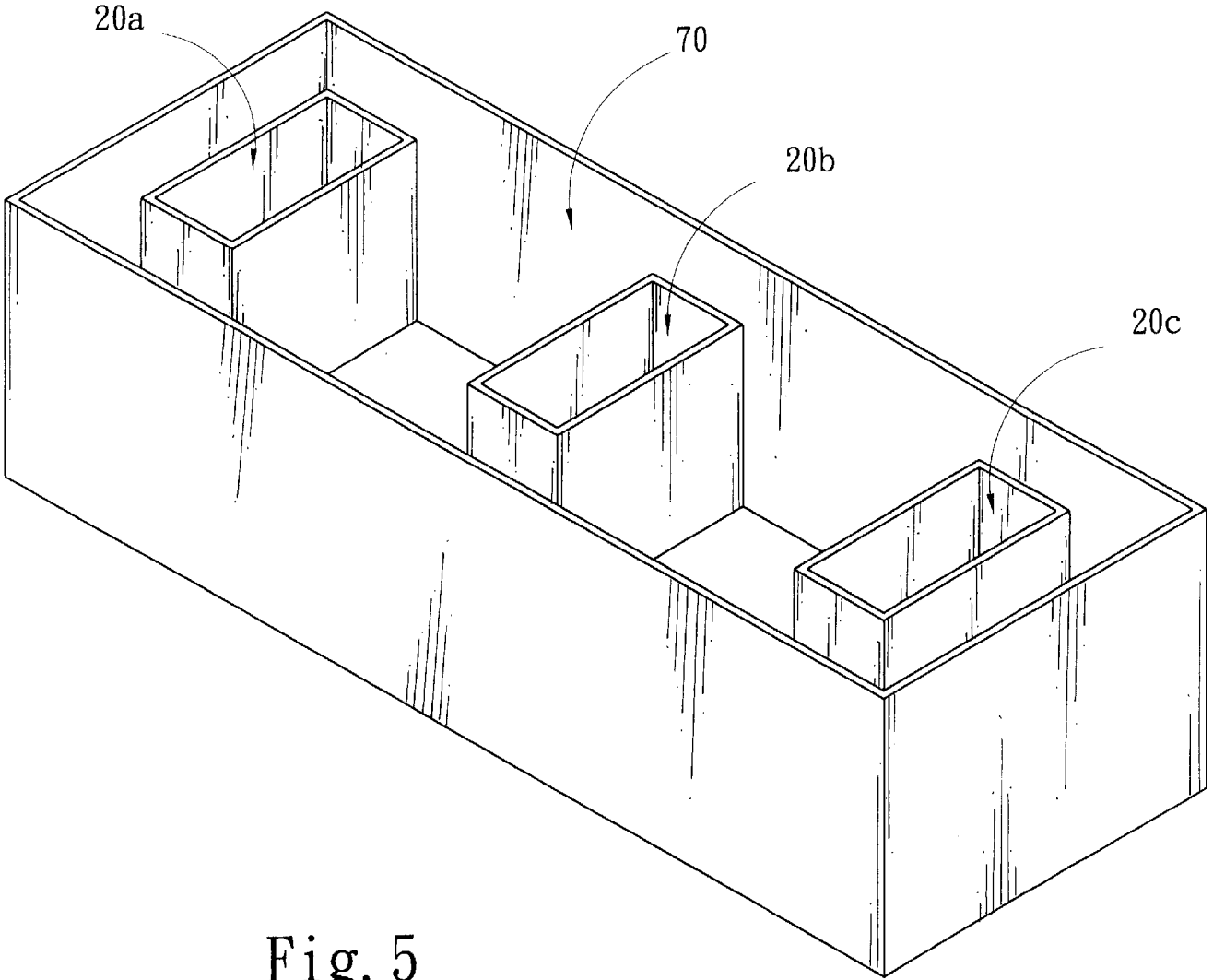
FIG. 5 is another embodiment of an ink storage space of the invention.

The ink storage spaces 20*a,* 20*b* and 20*c* that store different high-density colorants and their matching solvent storage spaces 70*a,* 70*b* and 70*c* can have another structure, as shown in FIG. 5. The solvent can be stored in a solvent storage space 70 that at least covers a whole inkjet head chip, and the ink storage spaces 20*a,* 20*b* and 20*c* that store different high-density colorants are arranged at the center of the solvent storage space. A proper distance is maintained between the ink storage spaces, so when solvent is added around each ink storage space it does not directly communicate therewith The above-mentioned inkjet printing unit is disposed between any two adjoining high-density colorants and solvents. Such an arrangement enables the solvent needed in the ink storage spaces 20*a,* 20*b* and 20*c* to be supplied from a single solvent storage space 70.

The multi-color level inkjet head chip of the invention can use a plurality of colored inks. First pre-mix different colored inks, then eject the mixed ink onto the surface of recording media. The desired color level can be obtained by controlling the pre-mixing volume of the different colored inks. Because the ink has already reached the desired expected color level, only one ejection is needed to obtain the required printing effect. Moreover, the printing speed will be increased.

The multi-color level inkjet head chip of the invention can mix high-density colorants and solvents in advance to create the desired color inks, then eject it onto the surface of recording media. This can also increase printing speed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-color level inkjet head chip structure, utilized to eject a plurality of different color inks onto a surface of recording media, at least comprising an inkjet printing unit comprising:

a pre-mixing space, having an ink nozzle, enabling inks to pass through and to be ejected onto the surface of said recording media;

a plurality of ink providing elements, communicating a plurality of different color inks with said pre-mixing space;

a plurality of ink providing drivers, installed on said ink providing elements, utilized to inject different color inks into said pre-mixing space along introduction axes to mix according to the respective preset ink volume so as to get an expected color level ink; and an inkjet printing driver being installed in said pre-mixing space and being adjacent to the introduction axes, the inkjet printing driver being utilized to ejected said expected-color level ink onto the surface of said recording media.

2. The structure of claim 1, wherein said ink providing elements are connected to said pre-mixing space by means of a plurality of tunnels.

3. The structure of claim 2, wherein said tunnels lead inks into location points of said pre-mixing space, which are distributed at position symmetrical to the center of said pre-mixing space.

4. The structure of claim 2, wherein said tunnels lead inks into location points of said pre-mixing space, which are distributed at equally divided positions of a circumference that takes the center of said pre-mixing space as a circle center.

5. The structure of claim 1, wherein said ink providing elements are positioned around the circumference of said pre-mixing space.

6. The structure of claim 1, wherein said inkjet head chip further has a plurality of ink providing tunnels parallel or perpendicular to the surface thereof, each of said ink providing tunnels is utilized to communicate said ink providing element and one of a plurality of different color inks.

7. The structure of claim 1, wherein said ink providing drivers and said inkjet printing drivers are a heating resistance thin film structure.

8. The structure of claim 1, wherein said ink providing drivers further comprised an energy controlled means, utilized to inject the need ink volumes into said pre-mixing space.

9. The structure of claim 1, wherein at least three ink providing elements and ink providing drivers are provided and wherein the three ink providing elements each have an introduction axes and wherein the introduction axes fail to have a common intersection such that a whirlpool effect is created to mix color inks in the pre-mixing space.

10. The structure of claim 1, wherein the inkjet printing driver ejects expected color level ink in a direction orthogonal to the introduction axes.

11. A multi-color level inkjet head chip structure, utilized to eject high-density colorants and their solvents onto the surface of recording media, at least comprising an inkjet printing unit comprising:

a pre-mixing space, having an ink nozzle, enabling inks to pass through and to be ejected onto the surface of said recording media;

two ink providing elements, communicating said high-density colorants and solvent respectively with said pre-mixing space;

two ink providing drivers, installed respectively in said two ink providing elements, utilized to inject said high-density colorant and solvent along an introduction axes into said pre-mixing space to mix according to the respective preset injection volume so as to get an expected color level ink; and an inkjet printing driver being installed in said pre-mixing space and being adjacent to the introduction axes, the inkjet printing driver bring utilized to eject said expected color level ink onto the surface of said recording media.

12. The structure of claim 11, wherein said ink providing elements are positioned at the surroundings of said pre-mixing space.

13. The structure of claim 11, wherein said ink providing elements are connected to said pre-mixing space by means of a plurality of tunnels.

14. The structure of claim 13, wherein said tunnels lead solvents or high-density colorants into said pre-mixing space through the edge of said pre-mixing space, enabling solvent or high-density colorants to be into said pre-mixing space to form a whirlpool-like current field.

15. The structure of claim 11, wherein said ink providing drivers and said inkjet printing drivers are a heating resistance thin film structure.

16. The structure of claim 11, wherein said ink providing drivers further comprised an energy controlled means, utilized to inject the need ink volumes into said pre-mixing space.

17. The structure of claim 9, wherein the introduction axes fail to intersection such that a whirlpool effect is created to mix color inks in the pre-mixing space.

18. The structure of claim 9, wherein the inkjet printing driver ejects expected color level ink in a direction orthogonal to the introduction axes.

* * * * *